US007318431B1

(12) United States Patent
Holtan et al.

(10) Patent No.: US 7,318,431 B1
(45) Date of Patent: Jan. 15, 2008

(54) BIOMASS FUEL BURNING STOVE AND METHOD

(75) Inventors: Mark N. Holtan, Rogers, MN (US); Ross C. Embertson, Rogers, MN (US)

(73) Assignee: BixBy Energy Systems, Inc., Minneapolis, MN (US)

( * ) Notice: Subject to any disclaimer, the term of this patent is extended or adjusted under 35 U.S.C. 154(b) by 309 days.

(21) Appl. No.: 11/049,611

(22) Filed: Feb. 2, 2005

Related U.S. Application Data

(60) Provisional application No. 60/541,453, filed on Feb. 3, 2004.

(51) Int. Cl.
*F24B 13/04* (2006.01)
*F23K 3/00* (2006.01)

(52) U.S. Cl. ..... 126/7; 126/10; 126/73; 110/105; 110/293

(58) Field of Classification Search ..... 126/73, 126/7, 10, 68; 110/101 R, 341, 255, 257, 110/267, 275, 286, 293, 105, 243, 234, 118, 110/116

See application file for complete search history.

(56) References Cited

U.S. PATENT DOCUMENTS

| | | | | |
|---|---|---|---|---|
| 974,322 | A | 11/1910 | Wells | |
| 1,344,666 | A | 6/1920 | Westerberg | |
| 1,761,182 | A | 6/1930 | Crothers | |
| 2,161,342 | A | 6/1939 | Francis | |
| 2,163,825 | A | 6/1939 | Bros | |
| 2,167,955 | A | 8/1939 | McGee | |
| 3,610,182 | A * | 10/1971 | Stockman | 110/102 |
| 3,894,834 | A | 7/1975 | Estes | |
| 4,167,909 | A | 9/1979 | Dauvergne | |
| 4,203,374 | A | 5/1980 | Frederick | |
| 4,270,464 | A * | 6/1981 | Kerres | 99/482 |
| 4,274,344 | A | 6/1981 | Nider | |
| 4,285,328 | A | 8/1981 | Fritz et al. | |
| 4,480,557 | A | 11/1984 | Hochmuth | |
| 4,483,256 | A | 11/1984 | Brashear | |
| 4,545,309 | A | 10/1985 | Comtois | |
| 4,547,150 | A | 10/1985 | Vereecke | |
| 4,576,102 | A | 3/1986 | Rasmussen et al. | |
| 4,577,564 | A | 3/1986 | Tomita et al. | |
| 4,589,353 | A | 5/1986 | Bamver | |
| 4,589,355 | A | 5/1986 | Chastain et al. | |
| 4,622,905 | A | 11/1986 | MacDougall et al. | |
| 4,665,840 | A | 5/1987 | Yarnell | |
| 4,724,776 | A | 2/1988 | Foresto | |
| 4,989,521 | A | 2/1991 | Traeger et al. | |
| 5,105,797 | A | 4/1992 | Gulutzen et al. | |
| 5,133,266 | A | 7/1992 | Cullen | |
| 5,285,738 | A | 2/1994 | Cullen | |
| 5,351,633 | A | 10/1994 | Buckner | |
| 5,359,945 | A | 11/1994 | Buckner et al. | |
| 5,429,110 | A | 7/1995 | Burker et al. | |
| 5,522,327 | A | 6/1996 | Buckner et al. | |
| 5,983,885 | A | 11/1999 | Jarvi | |

* cited by examiner

*Primary Examiner*—Alfred Basichas
(74) *Attorney, Agent, or Firm*—Richard John Bartz

(57) ABSTRACT

A biomass pellet burning stove has a hopper storing biomass pellets which are transported from the hopper to a feeder tube with a rotating disc having slots for holding biomass pellets and allowing the biomass pellets to move from the slots into a feeder tube which directs the biomass pellets to a burn pot. The burn pot has first and second biomass burning chambers that separately burn biomass pellets by an efficient, environmental and economic compatible process.

28 Claims, 12 Drawing Sheets

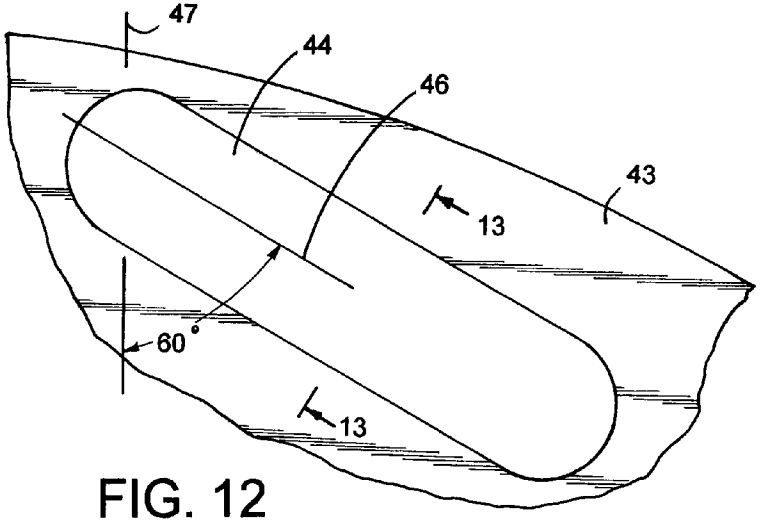
FIG. 12
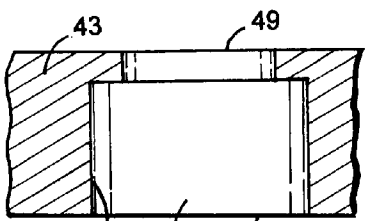
FIG. 13
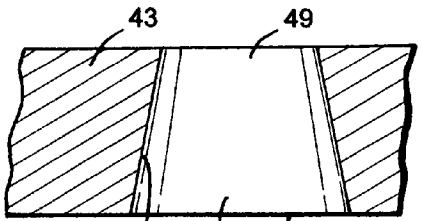
FIG. 14
FIG. 11
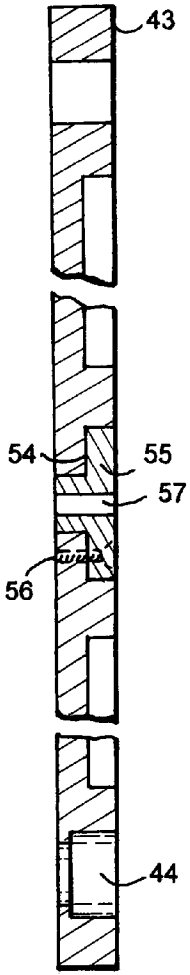
FIG. 10
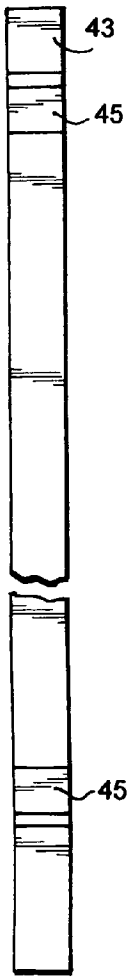

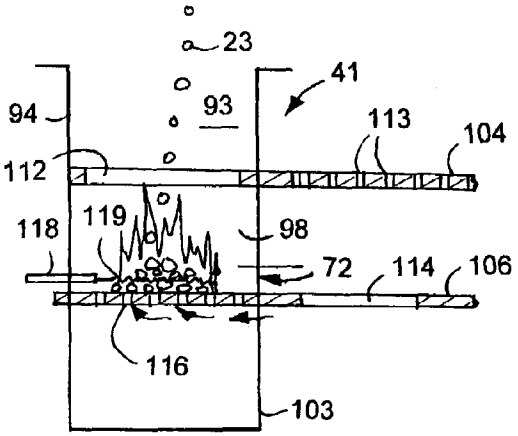
FIG. 24
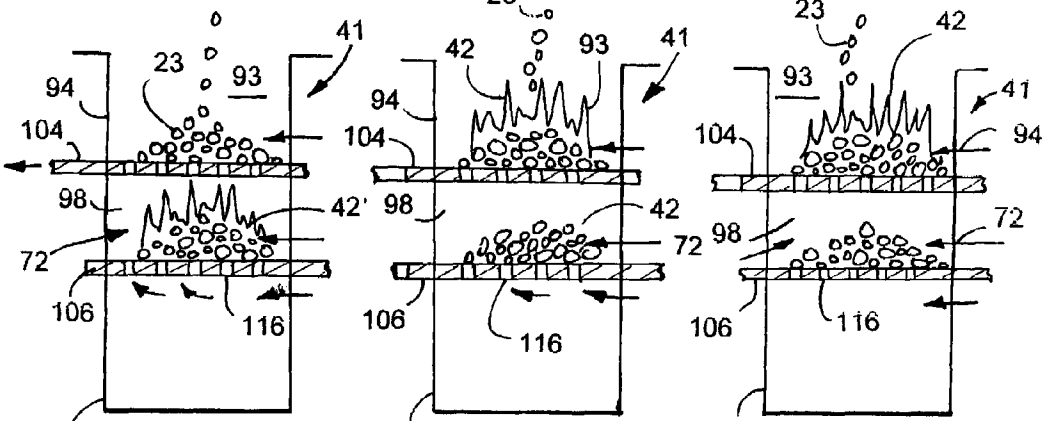
FIG. 25
FIG. 26
FIG. 27
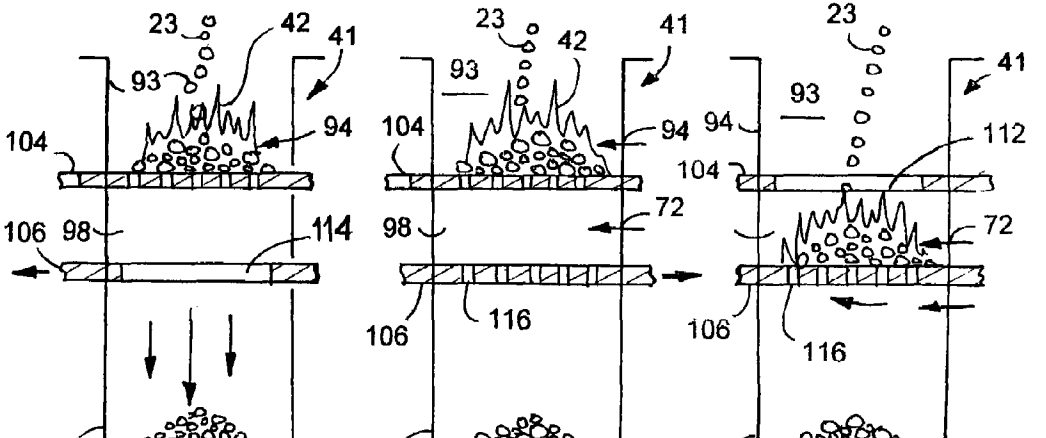
FIG. 28
FIG. 29
FIG. 30

BIOMASS FUEL BURNING STOVE AND METHOD

CROSS REFERENCE TO RELATED APPLICATION

This application claims the priority of U.S. Provisional Application Ser. No. 60/541,453 filed Feb. 3, 2004.

FIELD OF THE INVENTION

The invention relates to stoves which burn biomass fuel in the form of biomass pellets and a method of burning biomass pellets in an efficient and environmentally compatible manner.

Solid fuel burning stoves have been designed to use thermal combustion of renewable biomass products as a source of heat. The biomass products are typically wood, compressed organic waste pellets, shelled corn, wheat, rye and beans. One type of a biomass fuel is shelled feed corn. The use of animal feed corn provides the user with an inexpensive, clean and readily available renewable fuel. Corn kernels require a high temperature in order to sustain combustion and maintain high thermal efficiency with a minimum of hydrocarbon and $NO_x$ pollutants. Corn, when burning at a sustained temperature, burns cleanly and substantially completely so that cleaning of the stove is kept at a minimum. Examples of solid fuel burning stoves that function as space heaters are illustrated and described in the following U.S. Patents.

R. Comtois in U.S. Pat. No. 4,545,309 discloses a furnace for burning flammable particles, such as sawdust and wood bark biomass. The furnace has a vertical endless chain conveyer having buckets that pick up the biomass in a reservoir and dump the biomass into an inclined chute. The biomass moves down the chute and into a combustion chamber. In one embodiment, an auger driven with a motor moves the biomass from the chute into the combustion chamber. An air box having an upper wall with holes is connected to an oil burner operable to inject fuel oil into the combustion chamber and air into the air box which is discharged upwardly into the combustion chamber. The oil burner is controlled to start the combustion process. When the flammable particles are alighted, the oil is shut off. The combustion proceeds with the air from the air box.

A. M. Gulutzen and W. S. Gulutzen in U.S. Pat. No. 5,105,797 discloses a solid fuel burning stove having a hopper for storing pellet fuel, such as corn and a motor driven auger for moving the pellet fuel form the hopper to a burn pot. The burn pot has walls with apertures that allow forced air to flow into the combustion chamber to facilitate burning of the pellet fuel A valved air inlet is used to regulate the amount of air flowing to the combustion chamber to vary the rate of combustion of the pellet fuel.

L. D. Cullen in U.S. Pat. No. 5,133,266 illustrates a pellet burning heating device having an auger operable to move pellets from a hopper to a cylindrical burn pot. The bottom and side walls have a plurality of apertures. The total area of the apertures in the bottom wall and side wall below the pellet burn level in the burn pot is equal to the total area of the apertures above the pellet burn level. Combustion air is introduced to the burn pot below and above the pellet burn level to support burning of the pellets and gases in the burn pot.

C. E. Buckner in U.S. Pat. No. 5,359,945 discloses a pellet fuel burning heating unit having a hopper for storing pellet fuel within a housing. A motor driven auger moves the pellet fuel into a chute that directs the pellet fuel into a burn pot. A blower operates to supply air into a chamber below the burn pot. The burn pot has holes in its bottom walls and side walls which allows the air in the chamber to flow into the pellet fuel in the burn pot to maintain burning of the pellet fuel in the burn pot.

T. M. Burke and L. T. Burke in U.S. Pat. No. 5,429,110 discloses a pellet grill having a pellet storage compartment and a conveyor operable to move pellets from the storage compartment to a gravity chute that directs the pellets to a fire pot. A blower supplies air to the fire pot for combustion. The fire pot has holes over its bottom and sides whereby air is circulated around the pellets for efficient combustion.

M. A. Jarvi in U.S. Pat. No. 5,983,885 discloses a natural draft, gravity feed pellet stove having a burn pot having an open bottom allowing air from a draft pipe to flow upward into the burn pot to support combustion of pellets in the burn pot.

SUMMARY OF THE INVENTION

The invention comprises a biomass fuel burning stove having a novel biomass fuel transport assembly for moving biomass fuel from a hopper or bin to a burn pot and a novel burn pot. The burn pot embodies a biomass fuel burning method that maximized clean burning efficiency and BTU output with a minimum of environment pollutants. The stove automatically dispenses biomass fuel pellets to the burn pot and ignites the pellets. The biomass fuel burning process is automatically maintained to achieve a selected hot air temperature output.

The biomass fuel burning stove utilizes renewable biomass materials in the form of pellets, granular materials and feed grains, such as shelled feed corn. The term biomass fuels includes natural organic materials which can be burned to generate heat energy. The stove has a housing surrounding a hopper for storing biomass fuels. The biomass fuels are burned in a burn pot or fire box to generate heat energy. A heat exchanger converts hot combustion air and gasses into hot air which is moved into the environment adjacent the stove with a motor driven blower. A biomass fuel transport assembly moves biomass fuel from the hopper to a feeder member operable to direct biomass fuel to the burn pot. The biomass transport assembly includes a disc having at least one opening for holding biomass fuel. The disc preferably has a number of circumferentially spaced slots for holding biomass fuel pellets. The disc rides on a support plate mounted on an inside inclined wall of the hopper. A drive unit having a motor connected to the disc operates to rotate the disc to move the biomass fuel in an arcuate path from the bottom of the hopper to an exit opening in communication with the feeder member. The feeder member is preferably a downwardly extended tube having a passage that directs the biomass fuel into the burn pot. A shield located over the disc inhibits pressure on the disc from biomass fuel in the hopper. The disc is free to rotate with a minimum of biomass fuel forces applied to the top surface of the disc. The burn pot has first and second biomass fuel burning chambers separated with a movable first gate. A second movable gate located below the second chamber allows biomass ash to be dumped into a drawer or receiver and selectively retains biomass fuel in the second chamber. Each gate has a large opening and a plurality of holes spaced from the opening. When the opening is adjacent a chamber, biomass fuel flows through the chamber, and when the holes are aligned with a chamber, biomass fuels are retained in the chamber and air flows through the holes into the biomass fuel burning chambers.

Separate motor driven drive units connected to the gates operate to move the gates according to the burning cycle of the stove.

One method of burning biomass fuel in the burn pot of the stove is incorporated in the first and second burning chambers of the burn pot. Biomass fuel is first deposited in the second chamber and ignited to a temperature sufficient to sustain burning of the biomass fuel. Air flowing into the first and second chambers facilitates combustion of the biomass fuel. Additional biomass fuel is deposited in the first chamber and retained therein with a first gate. The additional biomass fuel is ignited by the heat generated by the burning of biomass fuel in the second chamber. The biomass fuels in the first and second chambers are simultaneously burned until the burning of the biomass fuel in the second chamber is substantially completed and reduced to ash. The ash is then dumped into a drawer. The biomass fuel in the first chamber continues to burn. The burning biomass fuel in the first chamber is then dumped into the second chamber and continues to burn therein. The biomass burning process is repeated by depositing more biomass fuel in the first chamber.

Another method of burning biomass fuel in the burn pot of the stove is incorporated in the second chamber of the burn pot. Biomass fuel is deposited in the second chamber and ignited to a temperature sufficient to sustain burning of the biomass fuel. Air introduced into the first and second chambers facilitates combustion of the biomass fuel. Additional biomass fuel is deposited in the second chamber until the ash level has completely filled the second chamber. Once the fuel level reaches the first chamber, a mechanical slide gate isolates the second chamber from the first chamber. Another slide gate opens the bottom of the second chamber and the ash is then dumped into a drawer. The slide gates return, closing off the bottom of the second chamber and dumping the burning fuel bed from the first chamber into the second and continues to burn therein. The biomass burning process is repeated by depositing more biomass in the second chamber.

DESCRIPTION OF DRAWING

FIG. 10 is an enlarged foreshortened side elevational view of the biomass pellet feeder disc of FIG. 8;

FIG. 11 is an enlarged foreshortened sectional view taken along line 11-11 of FIG. 8;

FIG. 12 is an enlarged top plan view of a portion of the biomass feeder disc showing the slot for accommodating biomass pellets;

FIG. 13 is a sectional view taken along line 13-13 of FIG. 12;

FIG. 14 is a sectional view similar to FIG. 13 showing a modification of the slot for accommodating biomass particles;

FIG. 24 is a diagrammatic view of the burn pot illustrating the ignition of the biomass fuel;

FIGS. 25 to 30 are diagrammatic views of the burn pot illustrating the biomass fuel burning cycle of the stove.

DESCRIPTION OF THE INVENTION

Figure 2:
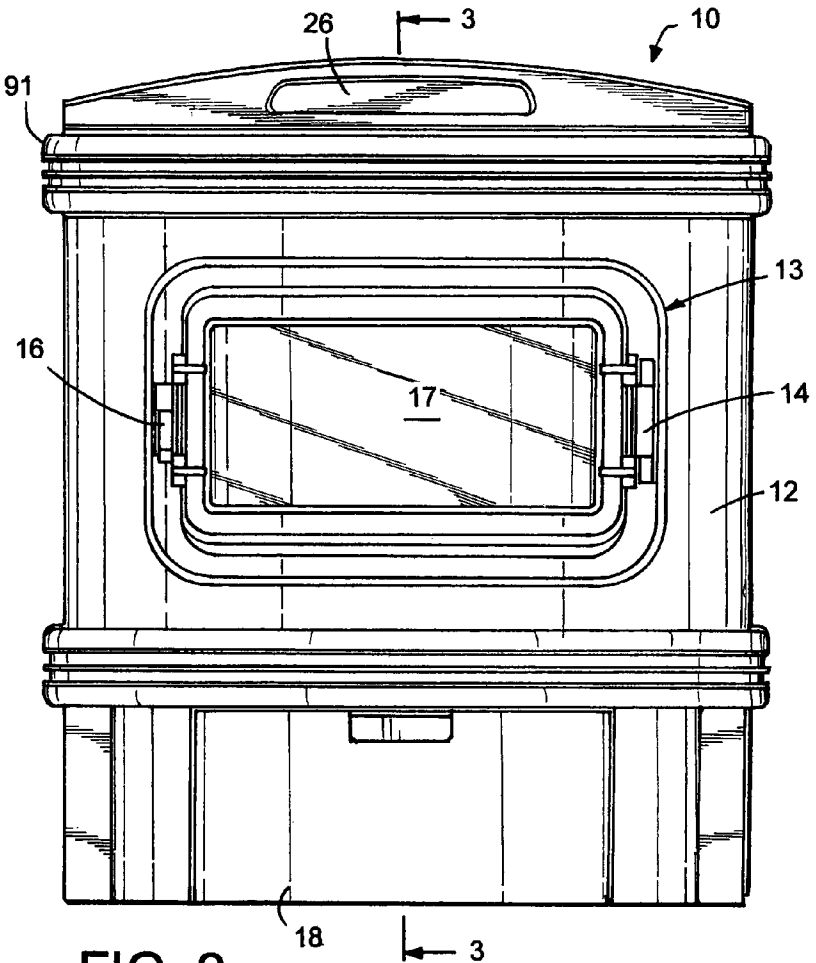
FIG. 2 is a front elevational view thereof.
Figure 1:
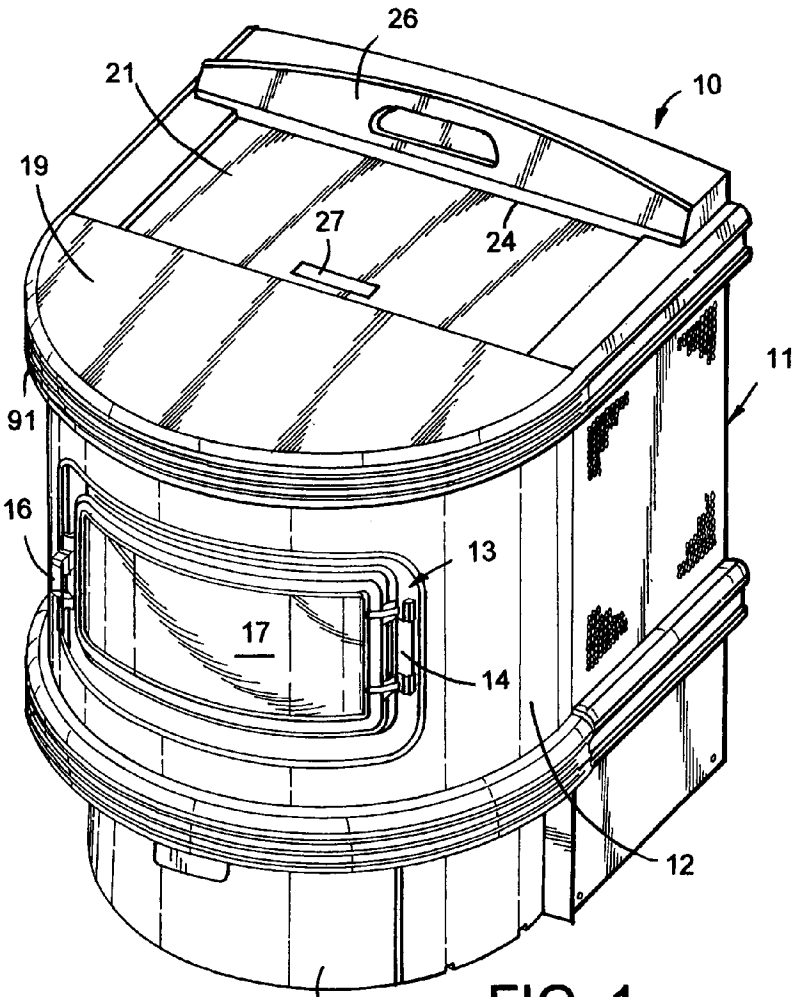
FIG. 1 is a perspective view of the biomass fuel burning stove of the invention.

The biomass fuel burning stove 10 of the invention, shown in FIGS. 1 and 2, is a self contained space heating apparatus operable to burn biomass fuel in a clean, efficient and environmentally compatible manner. Biomass fuels are organic materials available on a renewable basis that are raw or processed for use as combustible fuels to generate heat energy. One or more organic materials are converted into pellets having generally uniform sizes and densities to provide a biomass fuel with a high BTU per pound value. Biomass fuels include natural crops, including but not limited to, shelled corn, wheat, rye and beans. Biomass fuels include organic waste materials disclosed by R. A. Kruse in U.S. Pat. No. 6,136,590. Dry shelled feed corn has the desired elements contained in biomass pellets. Grades 1 to 3 feed corn is a relatively inexpensive, clean and readily available fuel for stove 10. Corn kernels require high temperatures to sustain thermal combustion for generating a continuous source of heat energy. Stove 10 incorporates a biomass pellet burning process that efficiently burns corn kernels, wood pellets, and biomass pellets in an environmentally compatible manner. The term biomass pellets as used herein includes these organic materials.

Stove 10 has an upright housing 11 enclosing its internal components and controls 120. Housing 11 has an upright convex curved front wall 12 having a generally rectangular door 13 providing access to the combustion chamber and burn pot of the stove. A hinge assembly 14 pivotally mounts one end of door 13 to wall 12 to allow door 13 to swing between open and closed positions. A latch 16 mounted on wall 12 cooperates with the other end of door 13 to hold door 13 in its closed position. Door 13 has a transparent window 17 that allows visual inspection of the combustion chamber and the flame of the burning biomass fuel. The bottom of stove 10 includes a panel 18 movable to an out location to provide access to a receiver, such as a drawer or tray 103 accommodating the ash of the residual of the biomass fuel.

Figure 3:
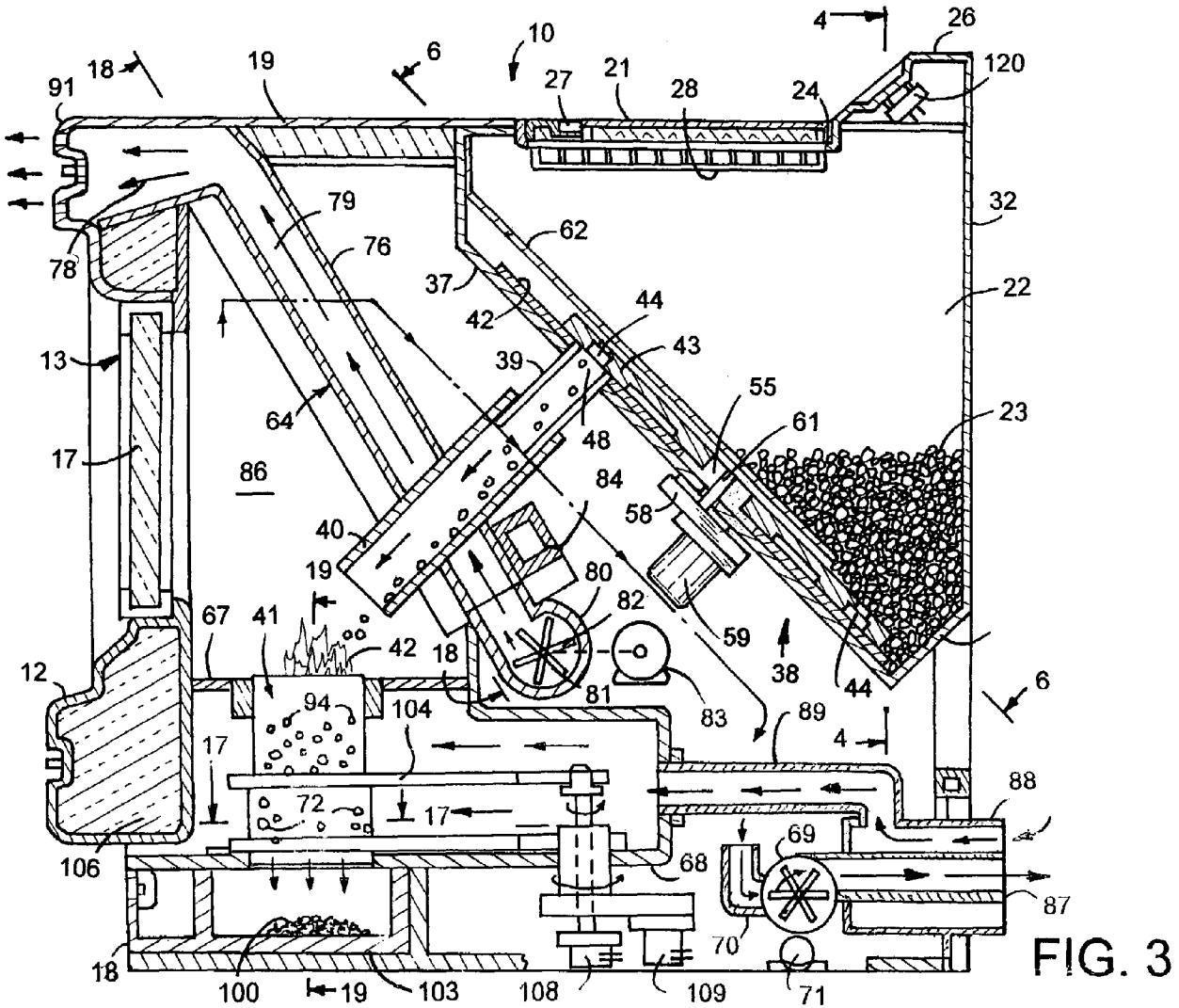
FIG. 3 is a sectional view taken along line 3-3 of FIG. 2.
Figure 5:
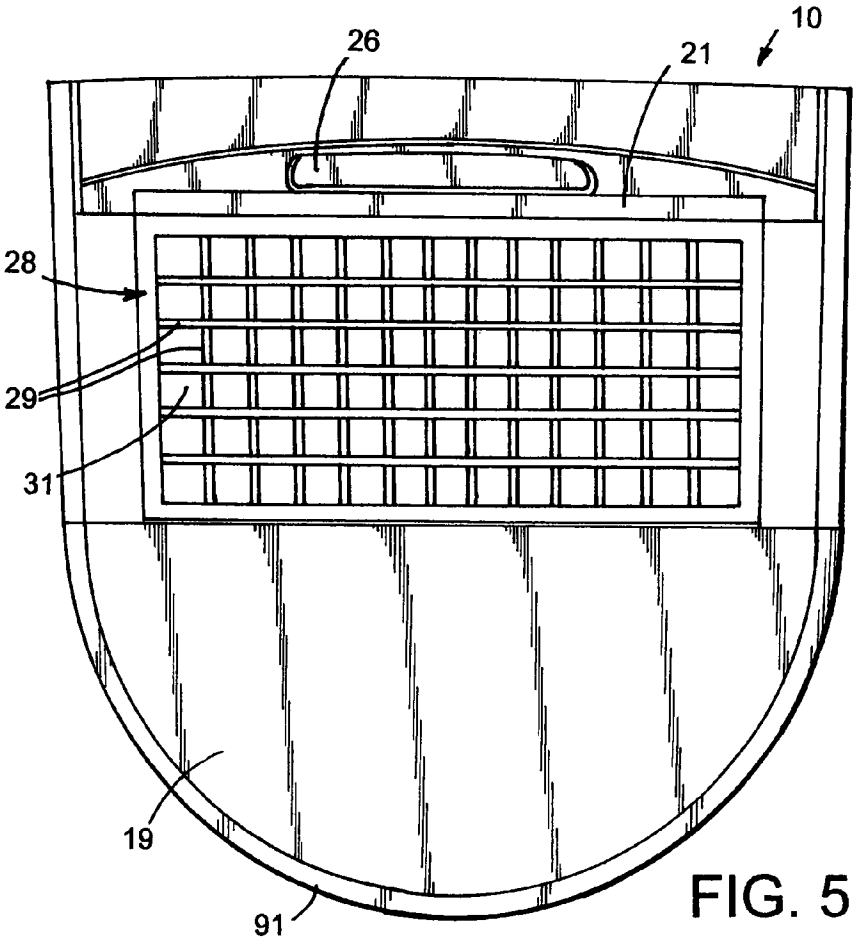
FIG. 5 is a top plan view of FIG. 1 showing the biomass fuel hopper door open.

Housing 11 includes a top wall 19 supporting a rectangular cover 21 closing the top opening of a hopper 22 for storing biomass fuel, illustrated as pellets or corn 23 as shown in FIG. 3. A transverse hinge assembly 24 pivotally mounts cover 21 on top wall in front of a control panel 26. The front of cover 21 has a recess 27 to facilitate manual opening of cover 21. As shown in FIGS. 3 and 5, a rectangular grid or screen 28 mounted on top wall 19 below cover 21 is located in the inlet opening of hopper 22. Screen 28 has Cartesian arranged rods 29 surrounding openings 31 which allow biomass pellets 23 to fall into hopper 22 and prevent corn cobs and other objects from moving into hopper 22. Screen 28 sorts out unwanted corn cob and sheath residue that can clog the biomass fuel transfer apparatus for moving the biomass fuel from the hopper into the combustion chambers of a burn pot 41.

Figure 4:
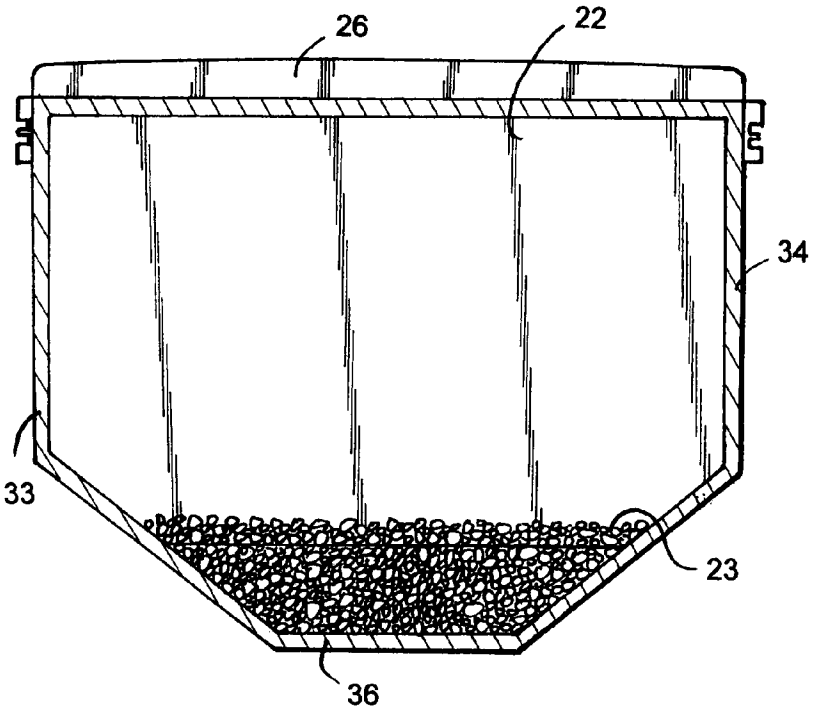
FIG. 4 is a sectional view taken along line 4-4 of FIG. 3.

As shown in FIGS. 3 and 4, hopper 22 has an upright rear wall 32, and side walls 33 and 34. The lower portions of side walls 33 and 34 taper inwardly and join to an inwardly directed bottom wall 36. A front wall 37 extends upwardly at a forward incline from bottom wall 36. The front wall 37 extends upwardly at an angle of about 45 degrees relative to a vertical plane of hopper 22. Wall 37 can have other slopes or inclined angles. The tapered portions of side walls 33 and 34 and inclined bottom wall 36 direct biomass fuel 23 toward the bottom of front wall 37. Hopper 22 is a large biomass fuel storage bin within housing 11. The capacity of the bin is about two bushels of shelled corn. The interior size of the bin can vary to hold a desirable amount of biomass fuels.

Figure 9:
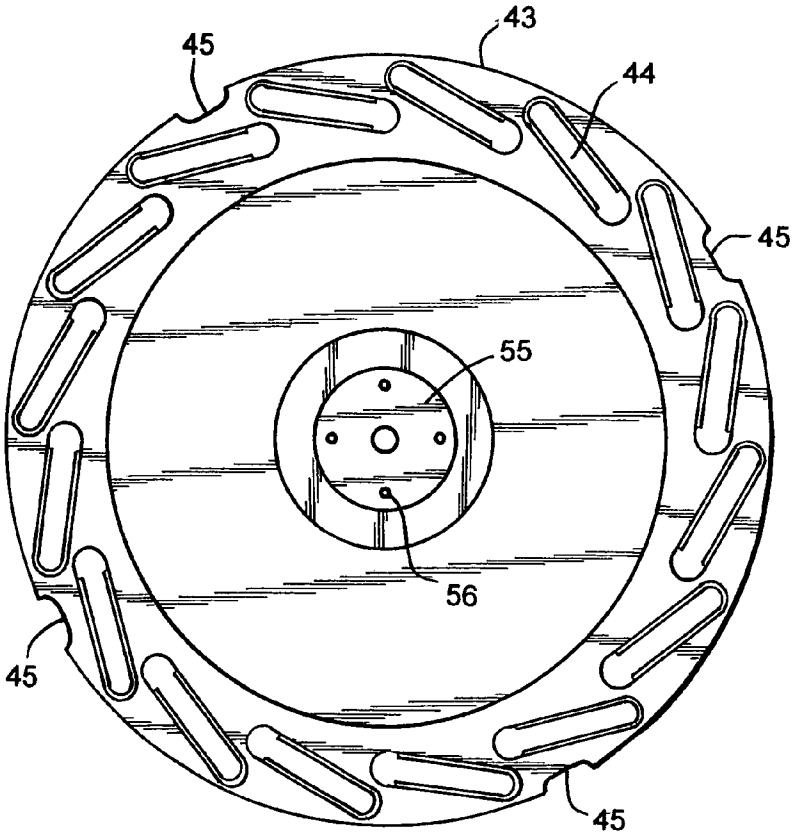
FIG. 9 is a bottom plan view of the biomass feeder disc of FIG. 8.
Figure 8:
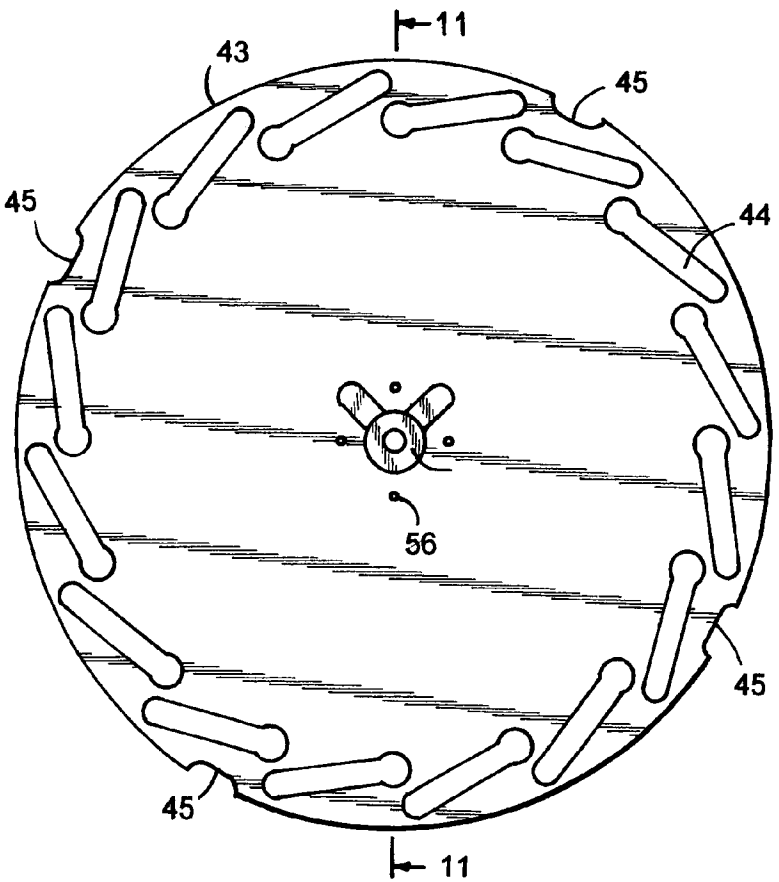
FIG. 8 is a top plan view of the biomass feeder disc of the stove of FIG. 1.
Figure 16:
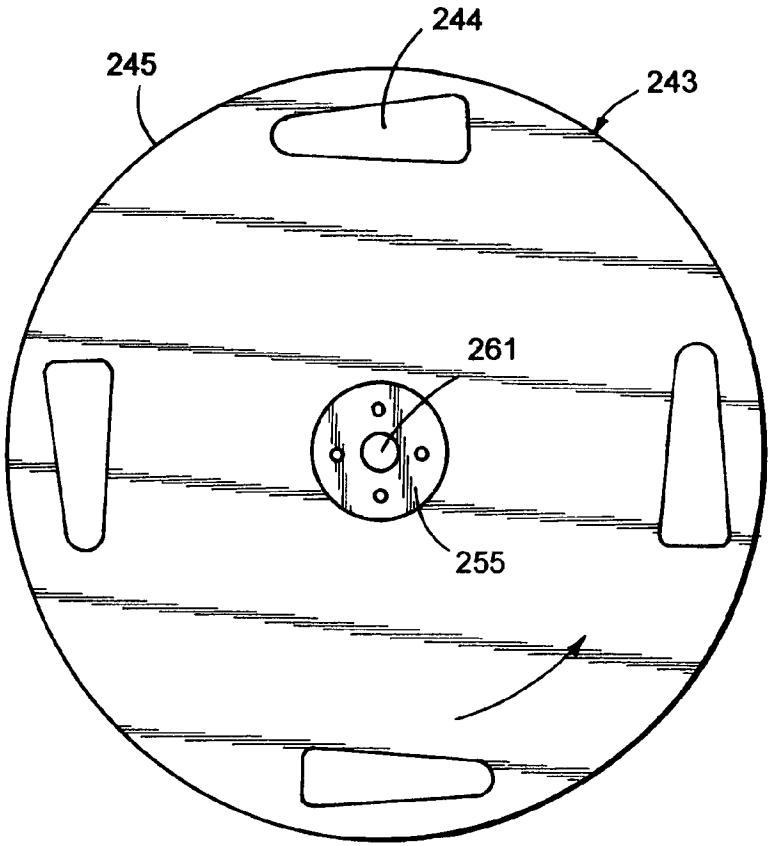
FIG. 16 is a top plan view of a second modification of the biomass pellet feeder disc.
Figure 15:
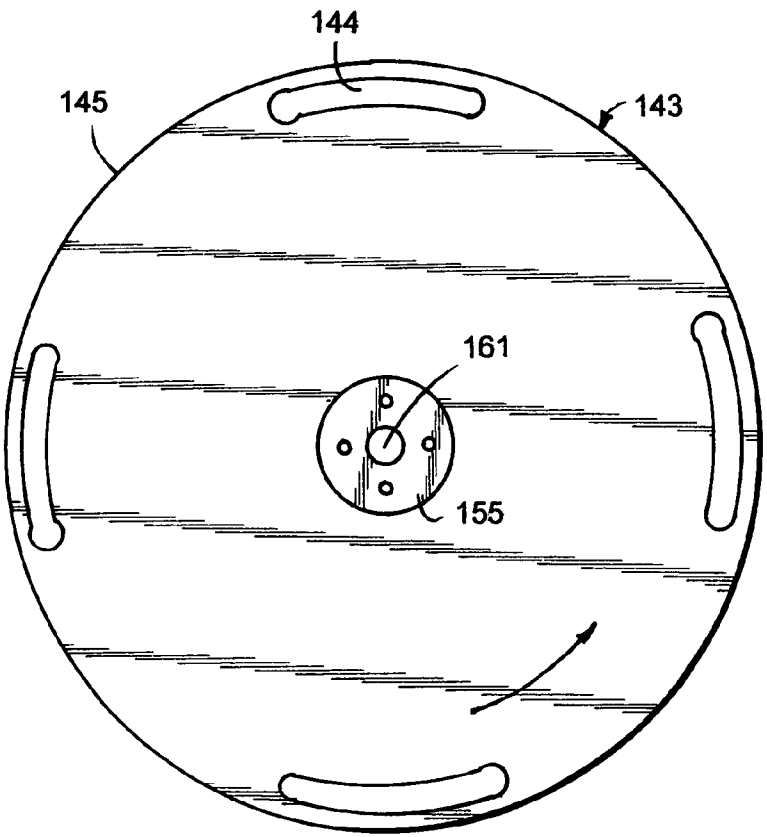
FIG. 15 is a top plan view of a first modification of the biomass pellet feeder disc.

A biomass fuel transport assembly or feeder 38 operates to pick up biomass fuel from the bottom of hopper 22 and discharge the biomass fuel into a feeder tube 39 which directs the biomass fuel into burn pot 41 having combustion chambers 93 and 98. Biomass fuel transport assembly 38 has a support shown as a flat plate 42 secured to the top side of front wall 37. Plate 42 has a flat outer surface supporting a circular wheel or flat disc 43 having elongated openings or slots 44 located in a circular path adjacent the outer circular peripheral edge or perimeter of disc 43. Each slot 44 has an elongated generally oval shape having a length of two inches (5 cm) and a width of one-half inch (1.3 cm). Slots 44 can have other shapes and dimensions. As shown in FIGS. 8, 9 and 12, each slot 44 has an elongated axis 46 inclined outwardly at an angle of 60 degrees relative to a diameter line 47 of disc 43 or tangent to disc diameter. The angle of each slot 44 helps to keep the biomass fuel from flowing forward as the slot 44 passes over the top of the arc of disc 43 as the biomass fuel drops into feeder tube 39. Slots 44 can have other shapes and inclined longitudinal axes. A first modification of the biomass fuel feeder disc, shown in FIG. 15, comprises a flat circular disc 143 having a plurality of circumferentially spaced arcuate slots 144 located inwardly of the outer peripheral edge 145. Slots 144 have arcs centered at the drive shaft 161 of the power transmitting unit operable to rotate disc 143. Drive shaft 161 is secured to a hub connected to disc 143. A second modification of biomass fuel feeder disc, shown in FIG. 16, comprises a flat circular disc 243 having a plurality of generally triangular slots 244 circumferentially located around and adjacent the outer perimeter 245. Each slot 244 has a small concave leading end and a large trailing end. The trailing end has a radial length about twice the radial length of the leading end. As shown in FIGS. 8 and 9, the adjacent ends of adjacent slots 44 circumferentially overlap to minimize dead spots in metering of biomass fuel to burn pot 41 and provide continuous pick-up of biomass fuel 23 at the bottom of hopper 22 and discharge of biomass fuel through hole 48 at the inlet of tube 39. As shown in FIG. 13, slot 44 has an inlet opening 49 on the outside of disc 43 and an outlet opening 51 on the inside of disc 43. Opening 51 is larger than opening 49 to prevent packing or wedging of the biomass fuel in slots 44 and allow the biomass fuel to fall from slots 44 into feeder tube 39. The inside wall 52 of slot 44, shown in FIG. 13, is stepped. An alternative inside wall 53 of slot 44, shown in FIG. 14, is tapered. The large outlet openings of slots 44 allows biomass pellets longer than the diameter of feeder tube 39 to tip and fall into feeder tube 39 without catching on the trailing ends of slots 44. The perimeter of disc 43 has a number of circumferentially spaced notches 45 operable to disturbing the biomass pellets when they bridge in hopper 22 and to promote the flow of biomass pellets toward disc 43 when hopper 22 is nearly empty. Disc 43 can have protrusions or fingers (not shown) to promote the flow of biomass pellets in the hopper toward feeder disc 43.

As shown in FIG. 11, disc 43 has a center stepped hole 54 accommodating a hub 54. Fasteners 56 secure hub 56 to disc 43. Hub 55 has a center bore 57. Returning to FIG. 3, a gear box 58 driven with an electric motor 59 is secured to the outside of hopper wall 37. Gear box 58 has a drive shaft 61 drivably connected to hub 56 whereby motor 59 through gear box 58 rotates disc 43 about the axis of shaft 61. Other types of power units and power transmitting devices can be used to rotate disc 43. Tension between disc 43 and adjacent surface of mounting plate 42 is adjusted during assembly of the hub 55 on drive shaft 61. A spring loaded attachment of the disc 43 to the hub 55 can also be used to adjust the surface contact force of disc 43 against mounting plate 42.

Figure 7:
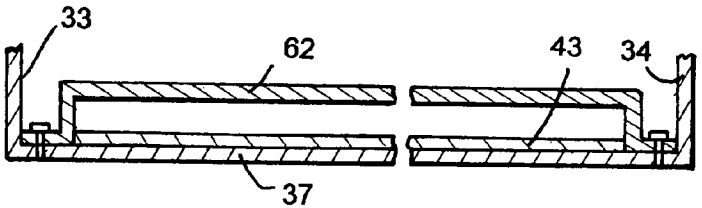
FIG. 7 is a foreshortened sectional view taken along line 7-7 of FIG. 6.
Figure 6:
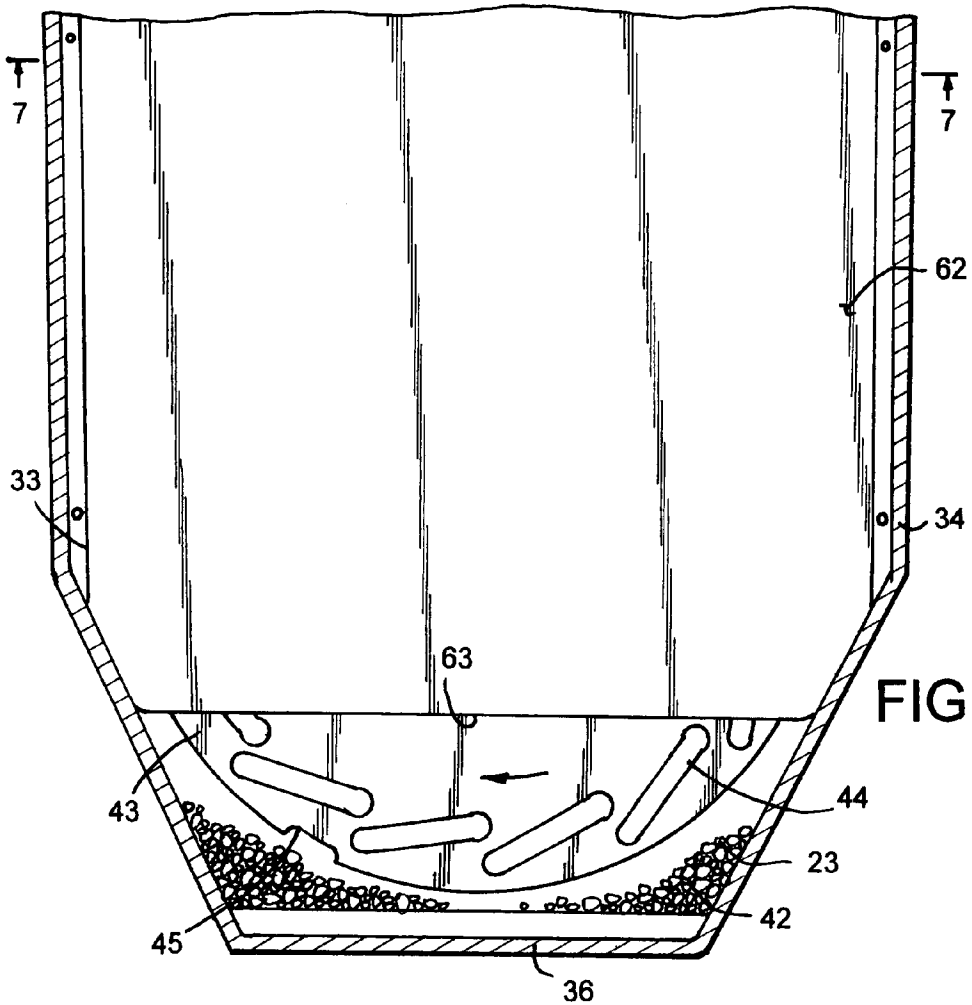
FIG. 6 is a sectional view taken along line 6-6 of FIG. 3.

As shown in FIGS. 3, 6 and 7, a restrictor plate 62 covers the upper and central portions of disc 43. Plate 62 located in hopper 22 extends from the top of hopper 22 downwardly over disc 43. As shown in FIG. 6, plate 62 has a bottom transverse edge 63 located above bottom wall 36 of hopper 22 providing a space exposing a lower portion of disc 43 to biomass fuel 23 in hopper 22. Plate 62 shields the center and upper portions of disc 43 from the pressure of biomass fuel pellets 23 in hopper 22. In addition, plate 62 restricts the flow of air from hopper 22 down through feeder tube 39 into burn pot 41. Air flow into the combustion chambers of burn pot 41 causes turbulence in the flame 42. Plate 62 also prevents pellets 23 from moving through an open slot 44 directly into feeder tube 39.

Figure 17:
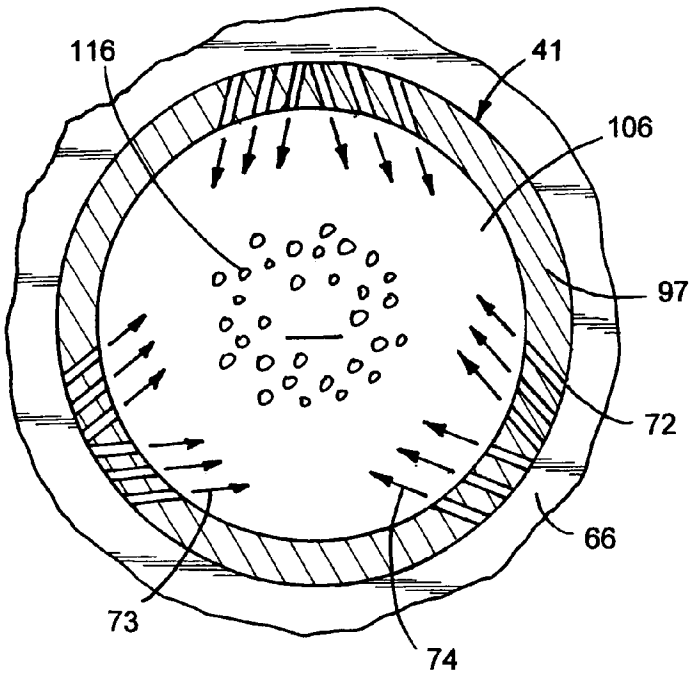
FIG. 17 is an enlarged sectional view taken along line 17-17 of FIG. 3.
Figure 20:
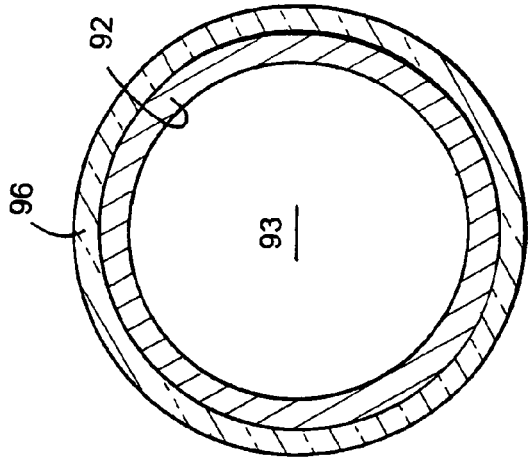
FIG. 20 is a sectional view taken along the line 20-20 of FIG. 19.

Returning to FIG. 3, burn pot 41 is located in an air chamber 66 between top and bottom walls 67 and 68. A conduit 70 connects chamber 66 with an air inlet sleeve 75 whereby external air flows through sleeve 75 and conduit 70 into chamber 66. A blower 69 driven with an electric motor 71 pulls a supply of air out of chamber 86 and reduces the pressure of the air in chamber 86. The negative pressure of the air in chamber 86 causes air to flow into chamber 66 and through burn pot 41 to sustain combustion of the biomass fuel in burn pot 41. A conduit 70 open to chamber 86 connected to blower 69 draws air and gases from chamber 86 which is discharged by blower 69 through an air exhaust sleeve 75. Sleeve 75 is joined to an air exhaust stack (not shown). External or outside air flows into chamber 66 through an air inlet sleeve 88 and conduit 89. Sleeve 88 is located around air exhaust sleeve 75. The speed of motor 71 is variable to regulate the rate of flow of air out of chamber 86 and the flow of air through holes or openings 72 and 94 into chambers 98 and 93. The air in chamber 66 flows through a number of openings 72 in burn pot 41 into the interior second combustion or burning chamber 98. As shown in FIG. 17, openings 72 are circumferentially spaced around burn pot 41 and extend along tangent lines in opposite or concurrent angular directions to direct air flow, shown by arrows 73 and 74, into chamber. The opposite or concurrent air flow 73 and 74 in chamber and combustion of biomass fuel creates substantial air turbulence and biomass fuel agitation with the result of efficient and substantially complete burning of the biomass fuel. Openings 94 have the same orientation as openings 72.

Figure 18:
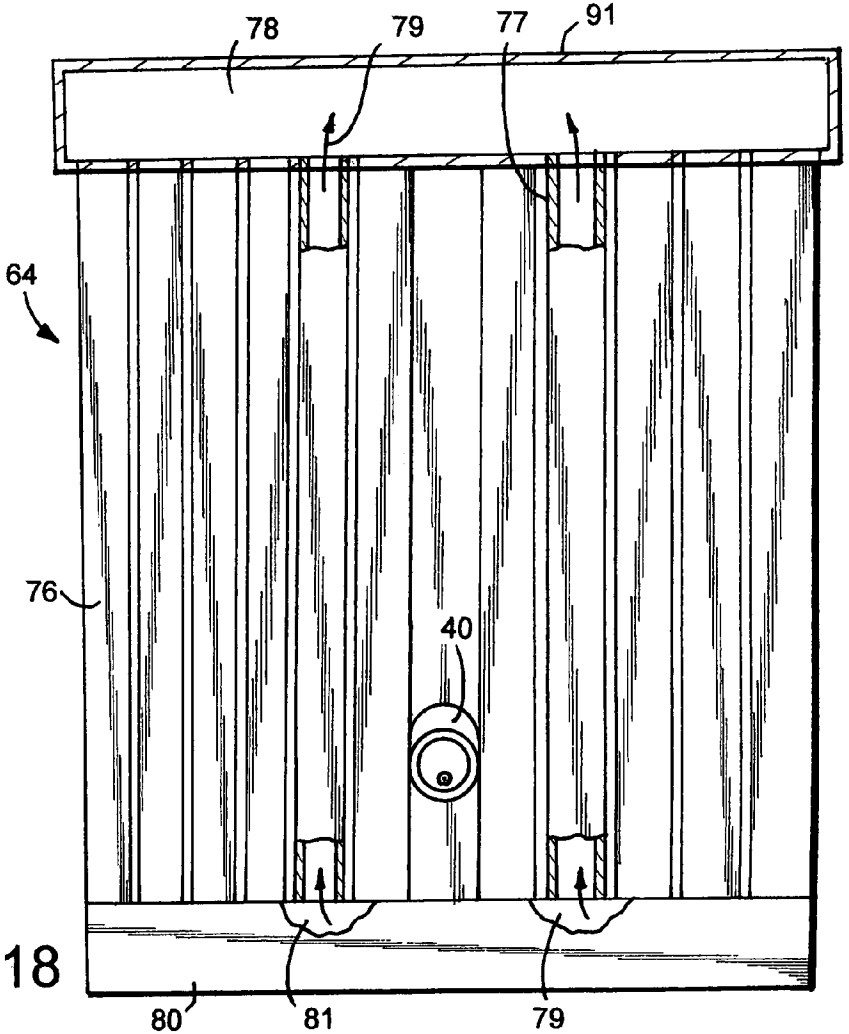
FIG. 18 is a sectional view taken along the line 18-18 of FIG. 3.

As shown in FIGS. 3 and 18, heat exchanger 64 extended upwardly and forwardly over the chamber 86 above burn pot 41 is connected to an air distributor or register 91 that directs hot air into the space surrounding stove 10. Heat exchanger 64 has a plurality of side-by-side metal tubes 76 extended between a transverse housing 81 and register 91. Adjacent tubes 76 are laterally spaced from each other to allow air and combustion gases to flow between adjacent tubes 76. Housing 80 has an internal chamber 81 accommodating a blower 82 driven with an electric motor 83 to move air, shown by arrows 79, through tubes 76 into register chamber 78. Tubes 76 have relatively thin metal cylindrical walls 77 which transfer heat from the hot air and gases surrounding tubes 76 to the air flowing in the passages of tubes 76. The speed of electric motor 83 is variable to regulate the operation of blower 82 and the resultant rate of flow of air through tubes 76. The metal of tubes 76 conducts heat or thermal energy from the hot air and gases in chamber 86 and transfers the conducted heat to the air in tubes 76. The rate of the transfer of heat energy is related to the differences in the temperatures of the air around tubes 76 and the air in tubes 76. As seen in FIG. 3, the feeder tube extension 40 extended through the center of heat exchanger 64 directs biomass fuel into burn pot 41. Heat exchanger 64 is spaced in front of front wall 37 of hopper 22 to allow air and combustion gases to flow to an exhaust pipe 87 open externally of stove 10.

Figure 19:
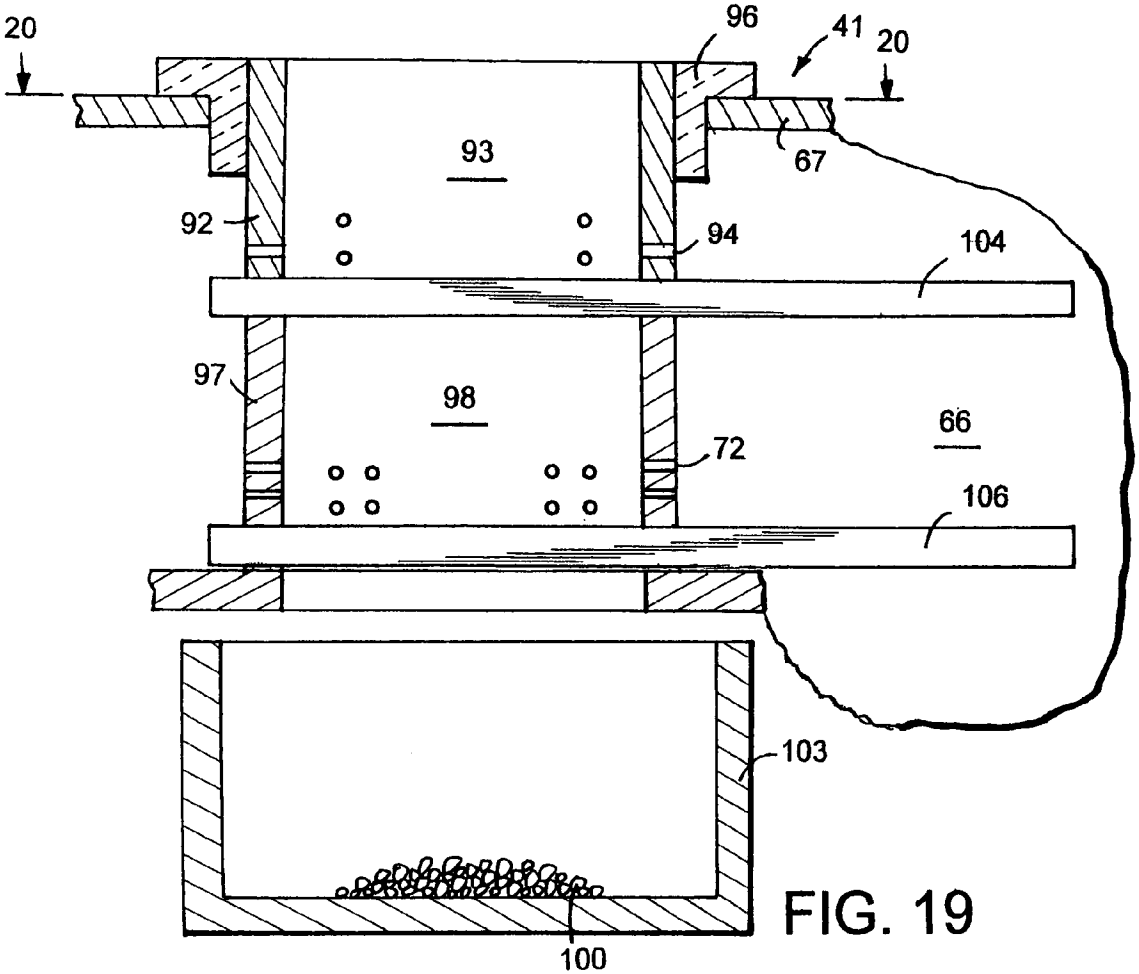
FIG. 19 is an enlarged sectional view taken along the line 19-19 of FIG. 3.

As shown in FIG. 19, burn pot 41 has a first cylindrical wall 92 surrounding a first or top biomass fuel burning chamber 93. A plurality of holes 94 in wall 92 allows air to flow from chamber 66 into biomass fuel burning chamber 93 to promote combustion of the biomass fuel in chamber 93. A collar 96 supported on wall 67 holds wall 92 in an upright position. The top of chamber 93 is open to heat exchanger chamber 86 and above the biomass fuel discharge end of tube 40. A second wall 97 located below wall 92 surrounds a second biomass burning chamber 98. As shown in FIG. 17, a plurality of holes 72 in wall 97 direct streams of air 73 and 74 into chamber 98 to facilitate combustion of the biomass fuel in chamber 98. When gate 106 is moved to its open position, ash wafer 100 from chamber 98 falls down into drawer 103, as shown in FIG. 27. The ash wafer or biomass fuel residue 100 in chamber 98 is dumped into an ash drawer 103 located below chamber 98. Ash drawer 103 is periodically removed from the bottom of stove 10 to allow the ash therein to be environmentally disposed of. A first mechanical slide gate 104 located between walls 92 and 97 retains biomass pellets 23 in first chamber 93 and allows the burning biomass fuel in chamber 93 to fall into second chamber 98. A second mechanical slide gate 106 between walls 97 and 103 retains biomass pellets in chamber 98 and dumps ash from chamber 98 into drawer 103.

Figure 23:
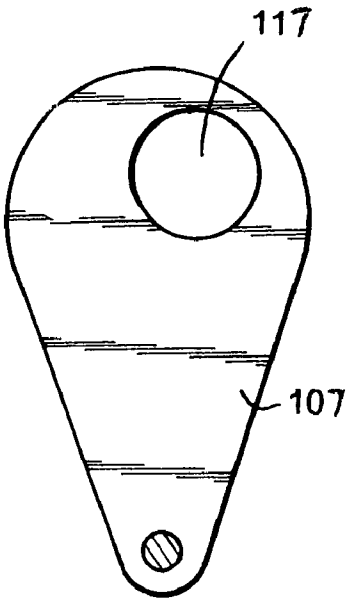
FIG. 23 is a top plan view of the top mechanical gate of the burn pot illustrated in FIGS. 31 to 35.
Figure 22:
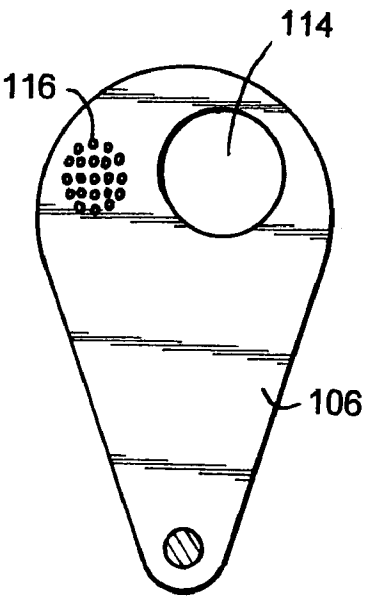
FIG. 22 is a top plan view of the mechanical slide gate below the second biomass burning chamber.
Figure 21:
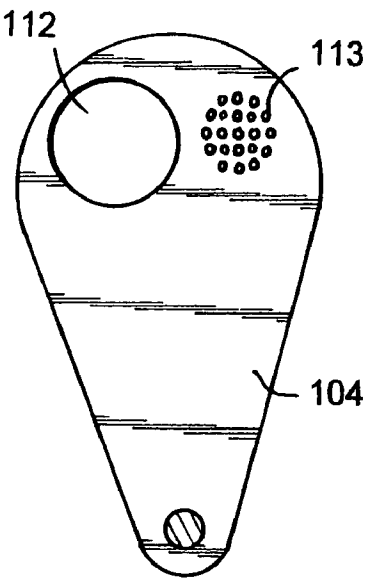
FIG. 21 is a top plan view of the mechanical slide gate between the first and second biomass burning chambers.
Figure 33:
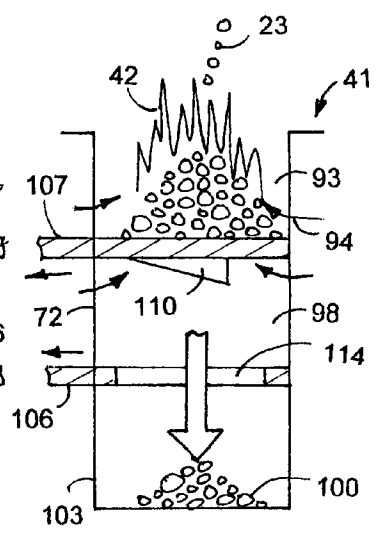
FIGS. 31 to 35 are diagrammatic views of the burn pot illustrating a modification of the biomass fuel burning cycle of the stove.

The top plan views of gates 104 and 106 are illustrated in FIGS. 21 and 22. Gate 104 has an opening 112 and a circular arrangement of holes 113 for allowing air to flow through holes 113 in gate 104 into first biomass fuel burning chamber 93. Motor 108 operably connected to gate 104, as seen in FIG. 3, laterally moves gate 104 to selectively align opening 112 and air holes 113 with biomass fuel burning chambers 93 and 98 in accordance with the burning process of stove 10. Gate 106 has an opening 114 and air holes 116 for allowing air to flow through gate 106 into second biomass fuel burning chamber 98. Opening 114 when aligned with chamber 98 allows ash in chamber 98 to dump into ash receiver or drawer 103. Motor 109 operably connected to gate 106, as seen in FIG. 3, moves gate 106 to selectively align opening 114 and holes 116 with second biomass pellet burning chamber 98. The top plan view of gate 107, shown in FIG. 23, is the top gate in the burn pot shown in FIGS. 31 to 35. Gate 107 is a generally flat plate having an opening 117 for allowing air and biomass fuel to flow through the gate. The bottom of gate 107 has a wedge or downwardly extended rib 110. Motor 108 drivably connected to gate 107 operates to swing gate 107 between open and closed positions. In use, when gate 107 is closed, as shown in FIG. 33, wedge 110 pushes ash wafer 110 from chamber 98 downwardly toward drawer 103.

As shown in FIG. 24, biomass fuel 23 is deposited in second biomass fuel burning chamber 98. Gate 104 is open with opening 112 aligned with chamber 93 allowing biomass fuel to flow through chamber 93. An electric igniter 118 having a heating coil 119 in chamber 98 connected to an electric power source and stove control 120 operates to commence the combustion of biomass fuel in chamber 98. Air flowing into chamber 98 and through holes 116 in gate 106 and holes 72 and 94 in burn pot wall promotes the burning of the biomass fuel. Igniter 118 is turned off after the burning biomass fuel has attained a temperature that supports continuous burning of the biomass fuel.

The biomass fuel burning cycle of stove 10 is illustrated in FIGS. 25 to 30. As shown in FIG. 25, after the biomass fuel in chamber 98 has been ignited, gate 104 is moved to the closed position and biomass fuel 23 is deposited in chamber 93. The heat and flame 42 generated by the burning biomass fuel in chamber 98 ignites the biomass fuel in chamber 93, as shown as flame 42 in FIG. 26.

The operation of stove 10 is controlled with a controller 120 located within control panel 26. Controller 120 has memory functions responsive to heat sensors and adjustable thermostats to regulate the heat energy output of stove 10. In use, as shown in FIG. 3, motor 59 drives power transmission 58 to turn disc 43. Biomass fuel 23 in the bottom of hopper 22 moves into slots 44 during rotation of disc 43. The biomass fuel in slots 44 are moved in an arcuate path by disc 43 upwardly along plate 42. When a slot 44 is aligned with inlet opening 48 of feeding tube 39, the biomass fuel 23 falls out of slot 44 into the passage of feeder tube 39 and tube extension 40. Tube extension 40 directs biomass fuel 23 into burn pot 41. The speed and duration of operation of motor 59 varies with the required heat energy output of stove 10. Motor 59 can be continuously operated to turn disc 43 to continuously supply burn pot with biomass fuel 23. Alternatively, motor 59 can be intermittently operated to turn disc 43. The biomass fuel in chambers 93 and 98 simultaneously burns as air from chamber 66 flows into biomass fuel burning chambers 93 and 98. This burning of biomass fuel continues until the biomass fuel in chamber 98 is reduced to ash 100, as shown in FIG. 27. Gate 106 is then moved to the open position, shown in FIG. 28, to dump ash 100 into ash drawer 103. The biomass fuel in chamber 93 continues to burn. Gate 106 is moved to the closed position as soon as the ash is dumped into ash drawer 103. FIG. 29 shows gate 106 in the closed position and the biomass fuel burning in chamber 93. The burning biomass fuel in chamber 93 is then dropped into chamber 98 when gate 104 is moved to the open position as shown in FIG. 30. The biomass fuel disperses or separates during the fall into chamber 98 which facilitates maximum efficient burning of the biomass fuel. The biomass fuel burning cycle illustrated in FIGS. 24 to 29 is repeated as long as biomass fuel is deposited in burn pot 41. When disc 43 is continuously rotated, biomass pellets are continuously dispensed into burn pot 41.

Figure 32:
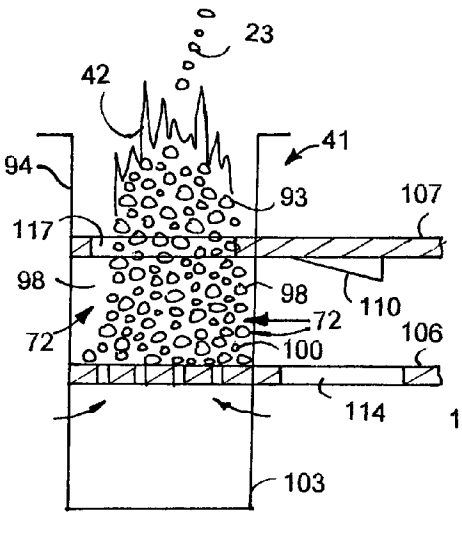
Figure 31:
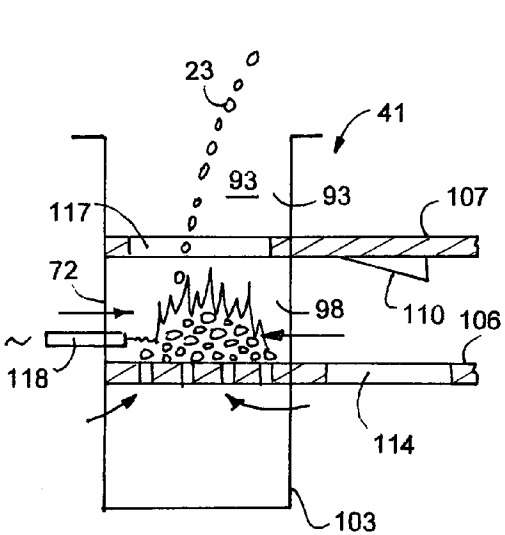
Figure 35:
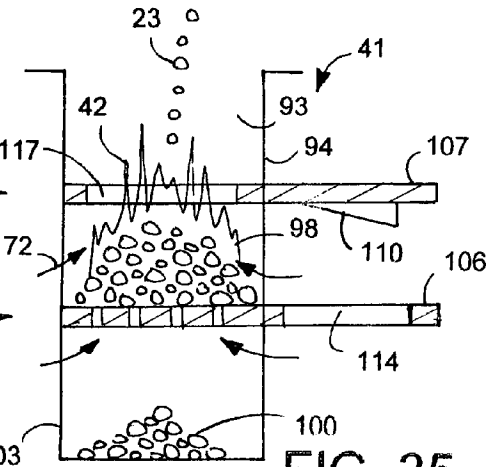
Figure 34:
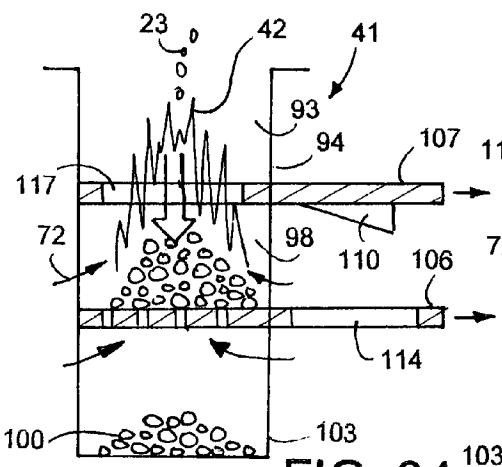

Another method of operation is described herein and shown in FIGS. 31 to 35. As shown in FIG. 31, biomass fuel 23 is deposited in second biomass fuel burning chamber 98. Gate 107 is open allowing biomass fuel to flow through chamber 93. An electric igniter having heating coil 119 in chamber 98 connected to an electric power source operates to commence the combustion of biomass in chamber 98. Air flowing into chamber 98 through holes 72 in burn pot 72 and holes in gate 106 promotes the burning of biomass fuel in chamber 98. Igniter 118 is turned off after the burning biomass fuel has attained a temperature that supports continuous burning of the biomass fuel. Biomass fuel 23 is fed continuously until the ash wafer 100 in chamber 98 is above gate 107, as shown in FIG. 32. Gate 107 is moved to the closed position, slicing through ash wafer 100 in chamber 98, and gate 106 moves to the open position. Wedge 110 forces ash wafer 100 down out of chamber 98. When gate 106 is in the open position, ash wafer 100 falls into ash drawer 103 as shown in FIG. 32. After ash wafer 100 falls from chamber 98 into ash drawer 103, gate 107 moves to the open position and gate 106 moves to the closed position. The biomass fuel burning in chamber 93 falls into chamber 98 where it continues to burn as shown in FIGS. 34 and 35. The biomass fuel burning cycle illustrated in FIGS. 31 to 34 is repeated as long as biomass fuel is deposited in burn pot 41.

It is to be understood that the present invention is not limited to the embodiments described and shown herein. Modifications of structures, controls, arrangement of parts and details of operation may be made by a person skilled in the art without departing from the invention.

The invention claimed is:

1. A biomass fuel burning stove comprising: a housing; a hopper for storing biomass fuel, said hopper having an upwardly and forwardly extended front wall, a burn pot having a chamber for holding and burning biomass fuel, a feeder member for directing biomass fuel to said chamber, and a biomass fuel transport assembly for moving biomass fuel from the hopper to the chamber of the burn pot, said transport assembly comprising a disc having at least one opening for accommodating biomass fuel, a support comprising a plate mounted on said front wall for holding the disc slidably engageable on said plate and allowing the disc to rotate relative to the plate, a biomass fuel restrictor shield located over said disc mounted on the hopper to space biomass fuel in said hopper from the disc, said shield having bottom portion spaced from a bottom section of the hopper whereby biomass fuel in the hopper contacts the disc in the bottom section of the hopper, said disc having a portion having said opening movable through a bottom section of the hopper to pick up biomass fuel in said opening and move the biomass fuel in the opening to the feeder member whereby the biomass fuel in said opening moves to the feeder member which directs the biomass fuel to said chamber of the burn pot, and a drive unit having a motor connected to the disc operable to rotate the disc.

2. The stove of claim 1 wherein: said disc has an outer peripheral edge, a plurality of circumferentially spaced openings in said disc located inwardly of said outer peripheral edge for holding biomass fuel.

3. The stove of claim 2 wherein: each of said openings comprise an elongated slot in said disc.

4. The stove of claim 2 wherein: adjacent openings have generally radially aligned adjacent ends.

5. The stove of claim 1 wherein: the opening has an biomass fuel inlet and a biomass fuel outlet, said outlet being larger than the inlet to allow biomass fuel to move from the opening to the feeder member.

6. The stove of claim 1 wherein: the shield includes a generally flat wall spaced above the disc.

7. The stove of claim 1 wherein: the disc has a plurality of circumferentially spaced openings for holding biomass fuel, each of said opening having a generally triangular shape.

8. The stove of claim 1 wherein: the feeder member comprises a downwardly and forwardly directed tube having an open inlet end for receiving biomass fuel from the opening in said disc and an open outlet end generally above the burn pot whereby biomass fuel is directed into the burn pot.

9. The stove of claim 1 wherein: said housing has a top wall having an opening open to said hopper, a screen mounted on the top wall extended across the opening for segregating large objects from the biomass fuel, and a door movably mounted on the housing for closing the opening, said door being movable to an open position to allow biomass fuel to be placed in the hopper.

10. A biomass fuel burning stove comprising: a housing; a hopper for storing biomass fuel, a burn pot having a chamber for holding and burning biomass fuel, a feeder member for directing biomass fuel to said chamber, and a biomass fuel transport assembly for moving biomass fuel from the hopper to the chamber of the burn pot, said transport assembly comprising a disc having at least one opening for accommodating biomass fuel, a support for holding the disc and allowing the disc to rotate relative to the support, said disc having a portion having said opening movable through a bottom section of the hopper to pick up biomass fuel in said opening and move the biomass fuel in the opening to the feeder member whereby the biomass fuel in said opening moves to the feeder member which directs the biomass fuel to said chamber of the burn pot, a drive unit having a motor connected to the disc operable to rotate the disc, said burn pot having a first wall surrounding a first biomass fuel burning chamber, a second wall located below the first wall having a second biomass fuel burning chamber, a first gate located between said first and second walls having a first opening connecting said first and second chambers and a plurality of first holes spaced from the first opening separating said first and second chambers, means for moving the first gate to selectively align the first opening and first holes between the first and second chambers to selectively allow biomass fuel to move from the first chamber into the second chamber and retain biomass fuel in the first chamber, a second gate located below the second wall having a second opening and a plurality of second holes spaced from the second opening open to the bottom of the second chamber, means for moving the second gate to selectively align the second opening and second holes with the second chamber to dump biomass ash from the second chamber and retain biomass fuel in the second chamber, and a drawer below the second gate for holding ash dumped from the second chamber and means for supplying air to the first and second chambers to maintain burning of the biomass fuel in the burn pot.

11. The stove of claim 10 wherein: said disc has an outer peripheral edge, a plurality of circumferentially spaced openings in said disc located inwardly of said outer peripheral edge for holding biomass fuel.

12. The stove of claim 11 wherein: each of said openings comprise an elongated slot in said disc.

13. The stove of claim 11 wherein: adjacent openings have generally radially aligned adjacent ends.

14. The stove of claim 10 wherein: the opening has an biomass fuel inlet and a biomass fuel outlet, said outlet being larger than the inlet to allow biomass fuel to move from the opening to the feeder member.

15. The stove of claim 10 wherein: the hopper has an upwardly and forwardly front wall, said support comprising a plate mounted on said front wall, said disc being slidably engageable with said plate, a biomass fuel restrictor shield located over said disc mounted on the hopper to space biomass fuel from the disc, said shield having a bottom portion spaced from a bottom section of the hopper whereby biomass fuel contacts the disc in bottom section of the hopper and biomass fuel is picked up in said opening in the disc.

16. The stove of claim 15 wherein: the shield includes a generally flat wall spaced above the disc.

17. The stove of claim 10 wherein: the disc has a plurality of circumferentially spaced openings for holding biomass fuel, each of said opening having a generally triangular shape.

18. The stove of claim 10 wherein: the feeder member comprises a downwardly and forwardly directed tube having an open inlet end for receiving biomass fuel from the opening in said disc and an open outlet end generally above the burn pot whereby biomass fuel is directed into the burn pot.

19. The stove of claim 10 wherein: said housing has a top wall having an opening open to said hopper, a screen mounted on the top wall extended across the opening for segregating large objects from the biomass fuel, and a door movably mounted on the housing for closing the opening, said door being movable to an open position to allow biomass fuel to be placed in the hopper.

20. The stove of claim 10 wherein: the first and second walls of the burn pot are generally cylindrical walls surrounding the first and second chambers.

21. The stove of claim 10 wherein: each of the first and second gates is a generally flat plate having an opening and plurality of holes spaced from the opening.

22. The stove of claim 10 including: an igniter located in the second chamber operable to commence burning of the biomass fuel in the second chamber.

23. The stove of claim 10 wherein: the first and second walls of the burn pot each have openings directing air in non-radial directions into the chambers to turbulize the air in the chambers to facilitate the burning of biomass fuel in said chambers.

24. The stove of claim 23 wherein: the openings are circumferentially spaced around said first and second wall to distribute turbulized air throughout said chambers.

25. The stove of claim 10 including: pivot means supporting the first and second gates for angular movement, and drive units connected to the gates operable to move the gates relative to the first and second walls to selectively locate the openings and holes in the gates adjacent the first and second chambers.

26. The stove of claim 10 including: a heat exchanger in said housing generally above the burn pot, and means for moving air through the heat exchanger and discharging heated air into the environment adjacent the stove.

27. The stove of claim 26 wherein: the heat exchanger comprises a plurality of tubes, and said means for moving air includes a blower and a motor for operating the blower to move air through the tubes and into the environment adjacent the stove.

28. The stove of claim 10 wherein: the means to supply air to the first and second chambers includes a blower and a motor for operating the blower to move air into the first and second chambers of the burn pot.

* * * * *